US007121805B2

(12) United States Patent
Chang et al.

(10) Patent No.: US 7,121,805 B2
(45) Date of Patent: Oct. 17, 2006

(54) ELECTRIC FAN WITH DETACHABLE BLADES

(75) Inventors: S. C. Chang, Yulin County (TW); Hung Ching Liu, Yulin County (TW)

(73) Assignee: Chang Ta Electric Industrial Co., Ltd., Yulin (TW)

( * ) Notice: Subject to any disclaimer, the term of this patent is extended or adjusted under 35 U.S.C. 154(b) by 120 days.

(21) Appl. No.: 10/862,958

(22) Filed: Jun. 7, 2004

(65) Prior Publication Data

US 2005/0271509 A1 Dec. 8, 2005

(51) Int. Cl.
*F01D 5/30* (2006.01)

(52) U.S. Cl. ..... 416/210 R; 416/219 A; 416/220 R; 416/234

(58) Field of Classification Search ..... 416/204 R, 416/214 R, 210 R, 234, 220 R, 220 A, 219 R, 416/219 A See application file for complete search history.

(56) References Cited

U.S. PATENT DOCUMENTS 752,670 A * 2/1904 Hamilton ..... 416/220 R
4,060,338 A * 11/1977 Macauley ..... 416/214 R
5,354,177 A * 10/1994 Chang ..... 416/219 A
5,476,366 A * 12/1995 Weihsmann ..... 416/220 A
5,573,376 A * 11/1996 Hayden et al. ..... 416/193 A
2004/0052641 A1* 3/2004 Chen ..... 416/220 A

* cited by examiner

*Primary Examiner*—Edward K. Look
*Assistant Examiner*—Nathan Wiehe
(74) *Attorney, Agent, or Firm*—Pro-Techtor Int'l Services

(57) ABSTRACT

An electric fan comprises a rotary hub comprising a hollow two-layer cylinder including a plurality of units each including: a gap between the layers, an axial first coupling edge abutted on an adjacent unit, an arcuate second coupling edge at its inner end joined with the first coupling edge, two internal ridges, and a rib interconnected the cylinder and a central sleeve; and a plurality of detachable blades comprising a blade section and a base including a raised member, a connecting edge in a joining portion of the blade section and the raised member, two side shoulders, and a forward, downward projection. Each base is inserted into the gap with the shoulders engaged with the ridges, the connecting edge engaged with the second coupling edge, and one side of the raised member engaged with the first coupling edge respectively. Also, each projection is threadedly secured to each rib.

1 Claim, 5 Drawing Sheets

ELECTRIC FAN WITH DETACHABLE BLADES

FIELD OF THE INVENTION

The present invention relates to electric fans and more particularly to such an electric fan (e.g., floor fan) with a plurality of detachable fan blades.

BACKGROUND OF THE INVENTION

Conventionally, fan blades of an electric fan are integrally formed with a rotary hub. From the point of view of manufacture, it has the benefit of decreasing the number of fan components. However, it may hinder delivery because a large space is, occupied by the hub and the blades. The required space is even larger if the electric fan has a large size. Thus, it is desirable to provide an electric fan having detachable blades in order to overcome the above drawback of prior art.

SUMMARY OF THE INVENTION

It is an object of the present invention to provide an electric fan comprising a rotary hub comprising a central sleeve and a hollow two-layer cylinder including a plurality of blade mounts each including a gap between the layers, an axial first coupling edge abutted on an adjacent blade mount, an arcuate second coupling edge joined with the first coupling edge at an inner end thereof, two axial, spaced, internal ridges, and a rib interconnected the cylinder and the sleeve, the rib having a threaded aperture; and a plurality of detachable revolving blades comprising a base, a blade section supported on the base, a raised member on the base, a connecting edge in a joining portion of the blade section and the raised member, two side shoulders on the base, and a radially inward projection having a hole; wherein the base of each blade is inserted into the gap with the shoulders matingly engaged with the ridges, the connecting edge matingly engaged with the second coupling edge, and one side of the raised member matingly engaged with the first coupling edge respectively, and a fastener is adapted to drive through the hole into the threaded aperture for securing each blade to each blade mount. By utilizing the present invention, the storage space of the blades can be greatly reduced for ease of delivery.

The above and other objects, features and advantages of the present invention will become apparent, from the following detailed description taken with the accompanying drawings.

DETAILED DESCRIPTION OF THE PREFERRED EMBODIMENTS

Figure 1:
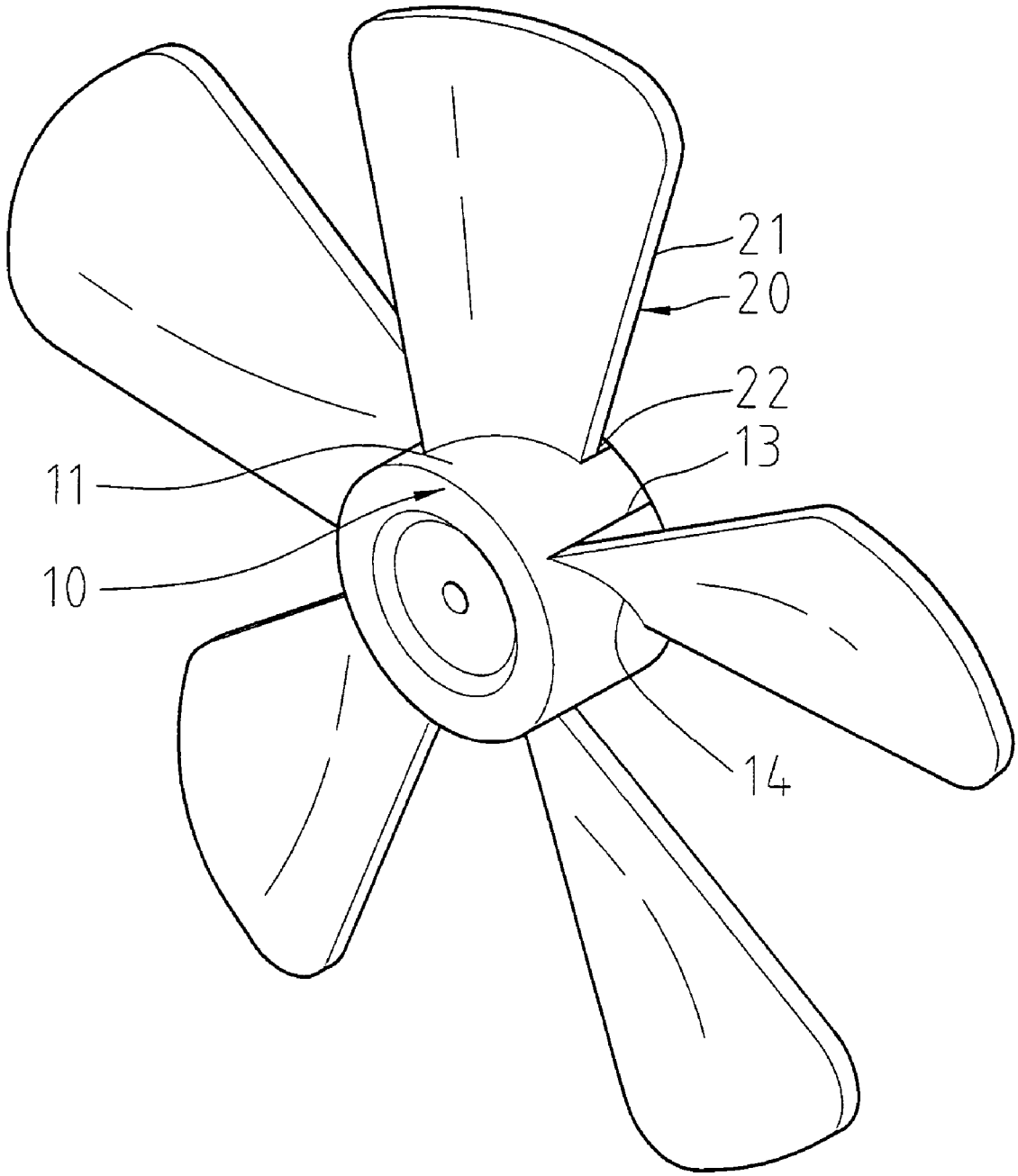
FIG. 1 is a perspective view of a preferred embodiment of fan blades assembled with hub of an electric fan according to the invention.
Figure 2:
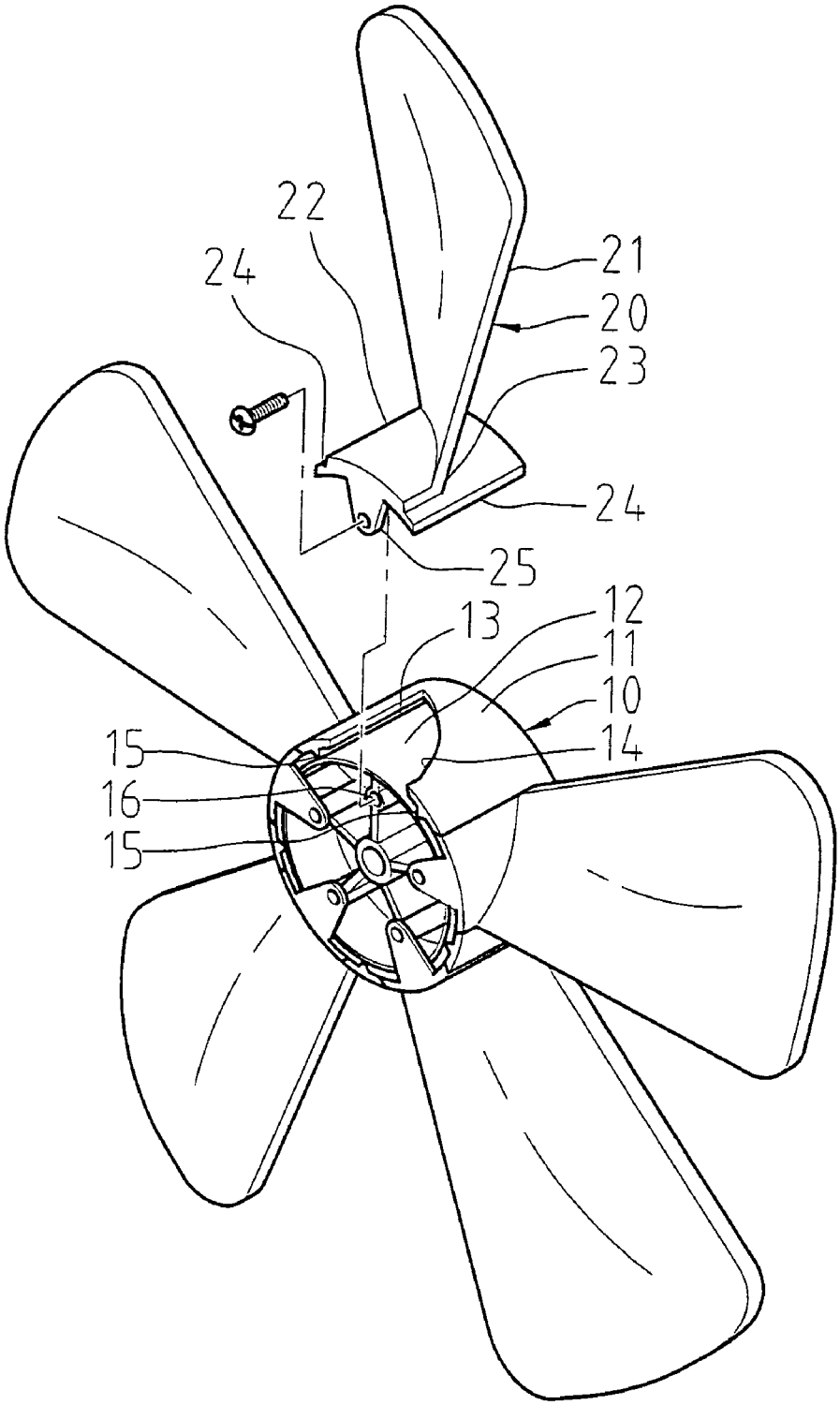
FIG. 2 is a partial exploded view of the blades and the hub.
Figure 3:
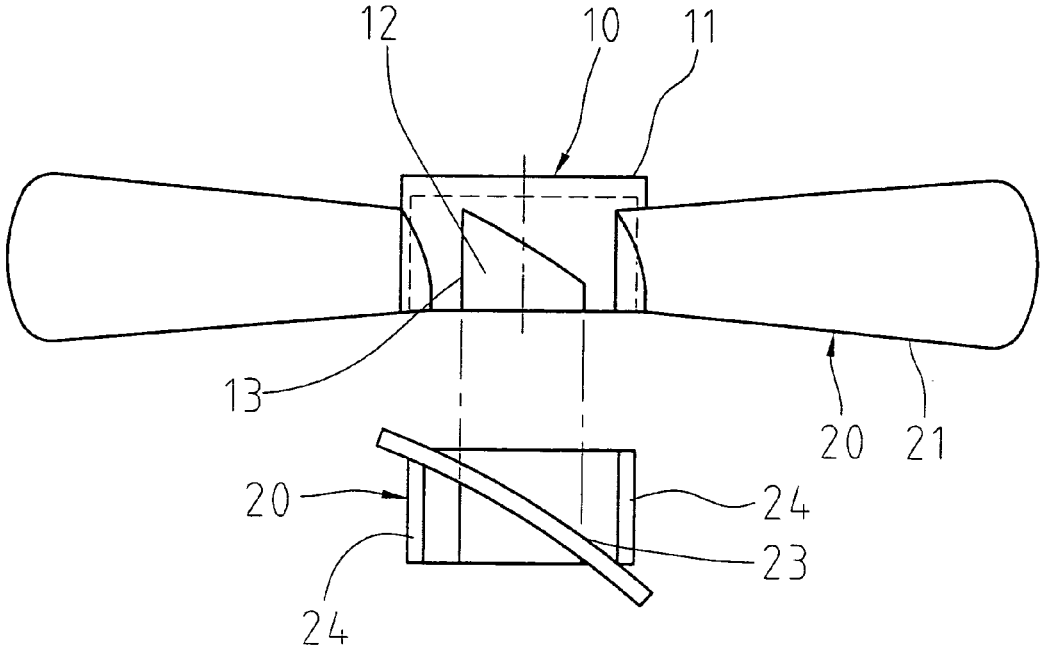
FIGS. 3 and 4 are top plan views showing a blade to be assembled with the hub and the blade assembled therewith respectively.
Figure 4:
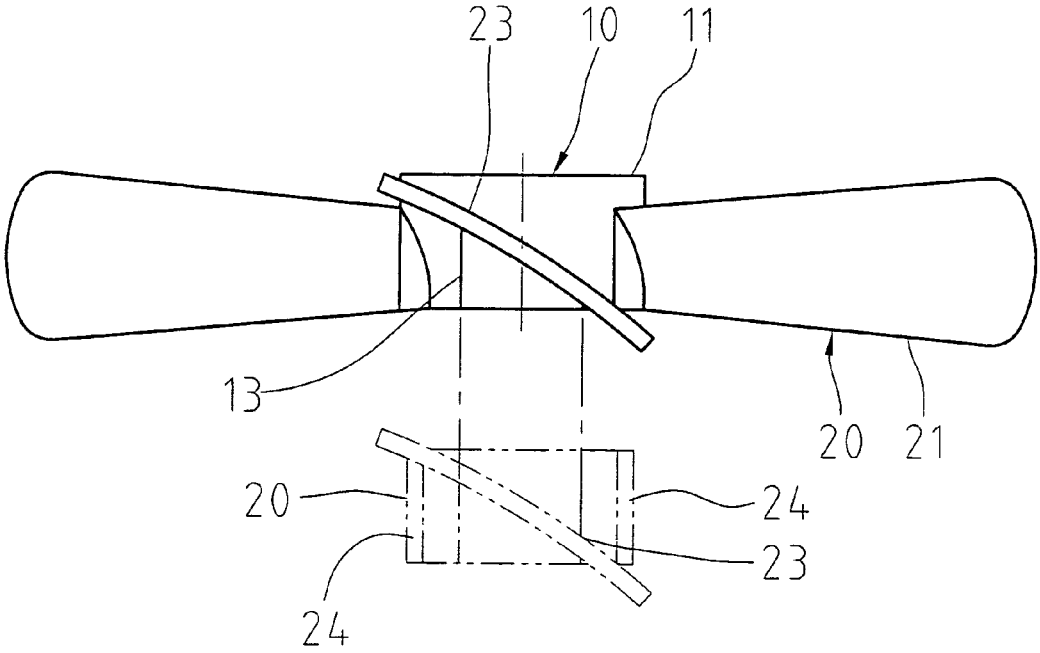
Figure 5:
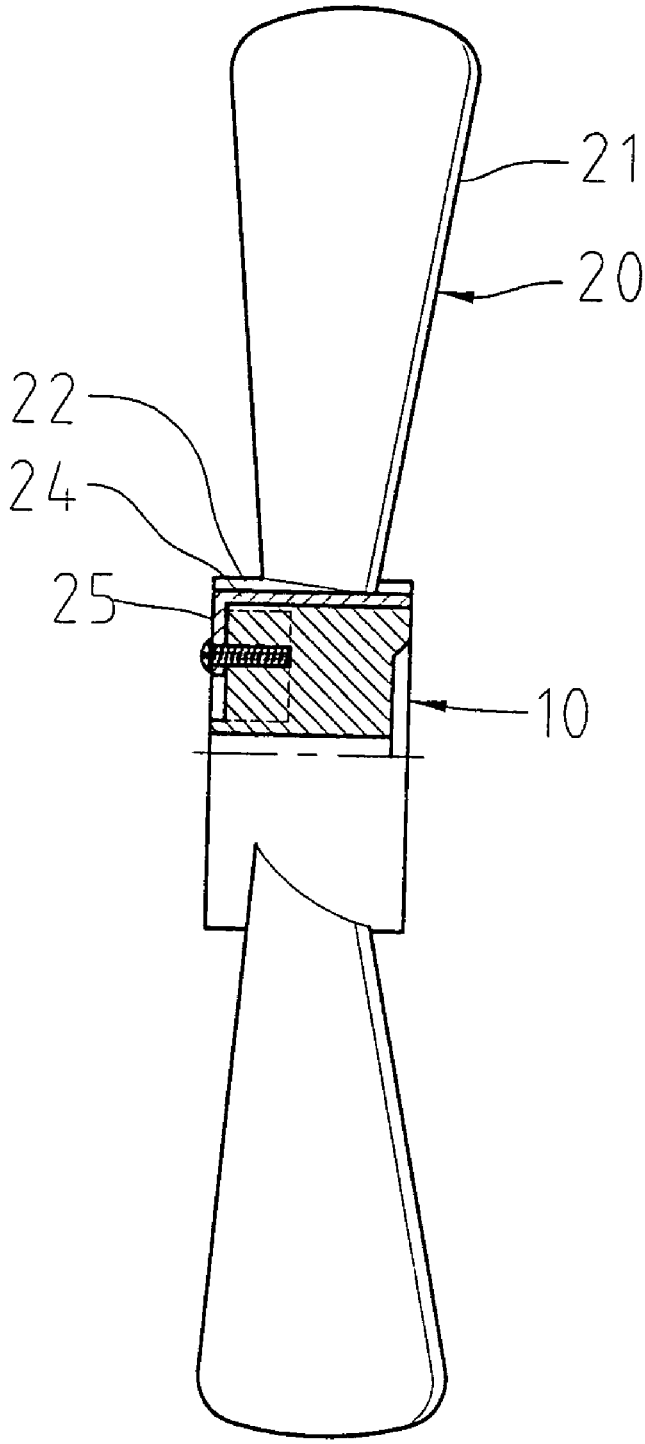
FIGS. 5 and 6 are side views in part section showing a blade to be assembled with the hub and the blade assembled therewith respectively.
Figure 6:
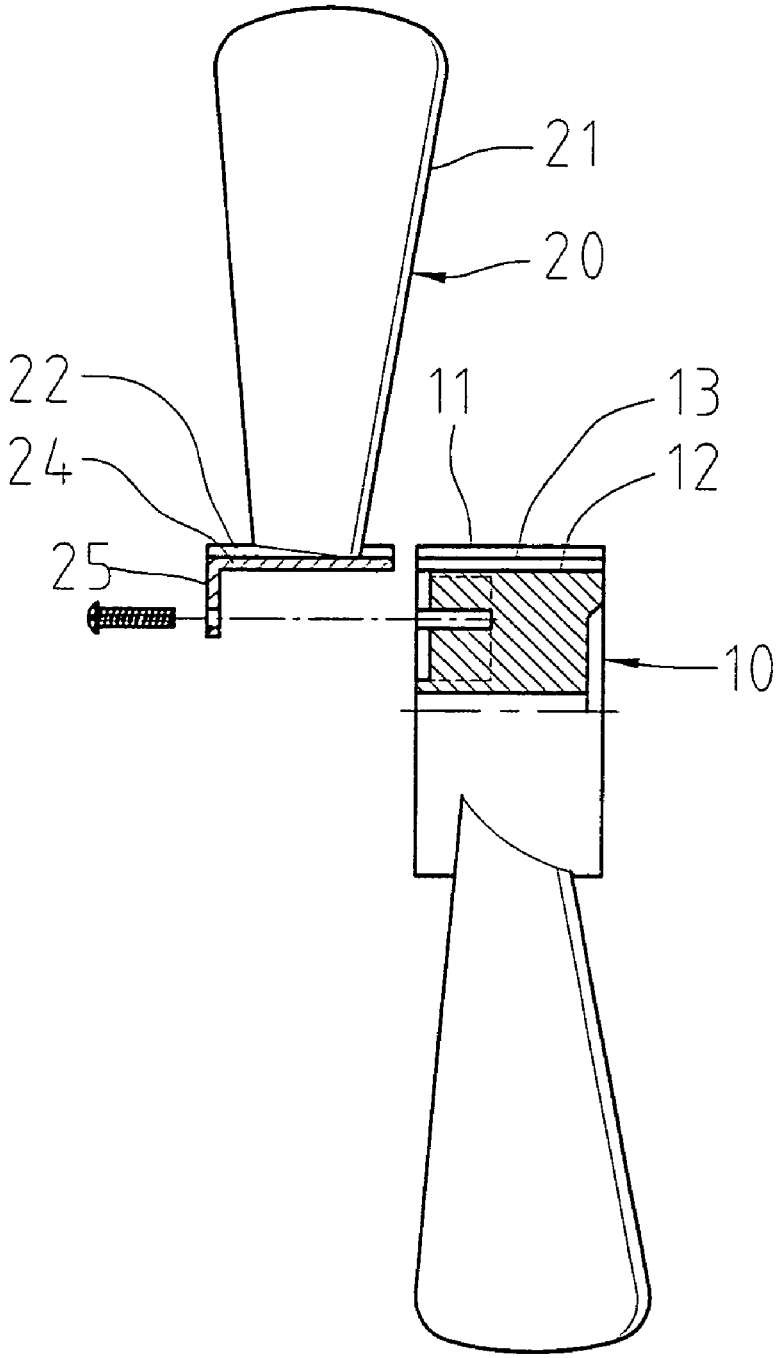

Referring to FIGS. 1 to 6, there is shown a rotary hub 10 and a plurality of detachable revolving blades 20 of an electric fan (e.g., floor fan) in accordance with the invention. The hub 10 comprises a hollow cylinder 11 having its outer surface consisting of two proximate layers. Each cylinder 11 comprises a plurality of blade mounts each including a gap 12 between the layers, an axial first coupling edge 13 abutted on an adjacent blade mount, an arcuate second coupling edge 14 joined with the first coupling edge 13 at an inner end, two axial, spaced, internal ridges 15, and a threaded aperture 16 in a rib interconnected the blade mount and a central sleeve.

The blade 20 comprises a blade section 21, a raised member 22 on a base integrally formed with the blade section 21, an edge 23 in a joining portion of the blade section 21 and the raised member 22, two side shoulders 24 lower than the raised member 22, the base of the blade 20 being inserted into the gap 12 with the shoulders 24 matingly engaged with the ridges 15, the edge 23 matingly engaged with the second coupling edge 14, and one side of the raised member 22 matingly engaged with the first coupling edge 13 respectively, and a hole 25 in a radially inward projection such that a fastener (e.g., screw) can be driven through the hole 25 into the threaded aperture 16 for fastening the blade 20 at the blade mount.

While the invention herein disclosed has been described by means of specific embodiments, numerous modifications and variations could be made thereto by those skilled in the art without departing from the scope and spirit of the invention set forth in the claims.

What is claimed is:

1. An electric fan comprising:

a rotary hub comprising a central sleeve and a hollow two-layer cylinder including a plurality of blade mounts each including a gap between the layers, an axial 5 first coupling edge abutted on an adjacent blade mount, an arcuate second coupling edge joined with the first coupling edge at an inner end thereof, two axial, spaced, internal ridges, and a rib interconnected the cylinder and the sleeve, the rib having a threaded aperture; and a plurality of detachable revolving blades comprising a base, a blade 10 section supported on the base, a raised member on the base, a connecting edge in a joining portion of the blade section and the raised member, two side shoulders on the base, and a radially inward projection having a hole;

wherein the base of each blade is inserted into the gap with the shoulders matingly engaged with the ridges, the connecting edge matingly engaged with 15 the second coupling edge, and one side of the raised member matingly engaged with the first coupling edge respectively, and a fastener is adapted to drive through the hole into the threaded aperture for securing each blade to each blade mount.

* * * * *